US006854954B2

(12) United States Patent
Hofer et al.

(10) Patent No.: US 6,854,954 B2
(45) Date of Patent: Feb. 15, 2005

(54) METHODS AND APPARATUS FOR ASSEMBLING TURBINE ENGINES

(75) Inventors: Douglas Carl Hofer, Clifton Park, NY (US); Daniel Mark Brown, Altamont, NY (US); Scott William Blackwell, Albany, NY (US); Norman Douglas Lathrop, Ballston Lake, NY (US); Edward John Sharrow, Scotia, NY (US)

(73) Assignee: General Electric Company, Schenectady, NY (US)

( * ) Notice: Subject to any disclaimer, the term of this patent is extended or adjusted under 35 U.S.C. 154(b) by 29 days.

(21) Appl. No.: 10/378,448

(22) Filed: Mar. 3, 2003

(65) Prior Publication Data

US 2004/0175267 A1 Sep. 9, 2004

(51) Int. Cl.[7] ..... F01D 1/24

(52) U.S. Cl. ..... 415/65; 415/93; 415/101; 415/199.4

(58) Field of Search ..... 415/199.4, 199.5, 415/219.1, 220, 65, 93, 94, 101, 102, 103

(56) References Cited

U.S. PATENT DOCUMENTS 3,690,786 A 9/1972 Silvestri, Jr.
3,773,431 A * 11/1973 Bellati et al. ..... 415/108
3,978,664 A 9/1976 Parker et al.
4,027,997 A 6/1977 Bryans
4,027,998 A * 6/1977 Schwartz ..... 415/213.1
4,232,993 A * 11/1980 Ikeda et al. ..... 415/103
4,272,955 A 6/1981 Hoffman et al.
4,458,479 A 7/1984 Reider et al.
4,483,149 A 11/1984 Rider et al.
4,527,386 A 7/1985 Markowski
4,571,153 A * 2/1986 Keller ..... 415/117
4,576,550 A 3/1986 Bryans
4,718,819 A 1/1988 Rogo et al.
4,900,223 A * 2/1990 Groenendaal, Jr. ..... 415/190
5,077,967 A 1/1992 Widener et al.
5,257,906 A 11/1993 Gray et al.
5,387,081 A 2/1995 LeBlanc
5,490,388 A 2/1996 Althaus et al.
5,564,898 A 10/1996 Richards et al.
5,592,820 A 1/1997 Alary et al.
5,603,605 A 2/1997 Fonda-Bonardi
5,984,628 A 11/1999 Gray et al.
6,048,169 A * 4/2000 Feldmuller et al. ..... 415/115
6,261,055 B1 7/2001 Owczarek

* cited by examiner

*Primary Examiner*—Hoang Nguyen
(74) *Attorney, Agent, or Firm*—William Scott Andes; Armstrong Teasdale LLP

(57) ABSTRACT

A method for assembling a power system is provided. The method includes coupling a first turbine and second turbine together with a coupling that extends between a first rotor of a first turbine and a second rotor of the second turbine, and such that the first turbine has fluid flow along a first flow path, and the second turbine has fluid flow along a second flow path. The method further includes fixedly coupling an outer wall to the first turbine that directs fluid flow from the first flow path towards the second flow path.

16 Claims, 3 Drawing Sheets

METHODS AND APPARATUS FOR ASSEMBLING TURBINE ENGINES

BACKGROUND OF THE INVENTION

The present invention relates generally to turbine engines and more particularly to methods and apparatus for improving performance of turbine engines that are axially coupled together.

At least some known power generating systems include at least two turbines coupled axially together via a coupling. More specifically, the turbines are connected such that their rotor shafts rotatably coupled and such that fluid flow exiting a final stage of an upstream turbine enters the first stage of a downstream turbine through a cavity defined between the turbines.

The cavity formed between the turbines may facilitate undesirable energy losses between the turbines. For example, because the rotating shaft and coupling are exposed to the flow path, as the shaft is rotated, fluid may become entrained and become ejected into flow path in a condition known as windage loss. In addition, undesirable flow separation losses may occur as the fluid contacts the coupling enroute to the downstream turbine. In addition, if an exit annulus of the upstream turbine has a different height or diameter than the entrance annulus of the downstream turbine, additional energy losses may occur as the fluid flow is channeled through the coupling.

Some known power generation systems supply additional steam to the coupling region. Additional steam is admitted as required by the thermodynamic cycle so as not to affect the coupling losses. However, the introduction of such steam may cause an undesirable disturbance to the fluid flowing through the coupling.

As such, other known power generation systems include a generally cylindrical coupling cover which overlies the rotating shaft and coupling and has an axis that is generally coincident with the axis of rotation of the turbines. Although the coupling cover facilitates mitigating losses associated with the rotating shaft and coupling, the additional cover also produces energy losses itself, and does not address recovering energy from the flowpath. Additionally, the coupling cover does not provide a means for retrofitting previously commissioned turbines.

BRIEF DESCRIPTION OF THE INVENTION

In one aspect, a method for assembling a power system is provided. The method includes coupling a first turbine and second turbine together with a coupling that extends between a first rotor of a first turbine and a second rotor of the second turbine, and such that the first turbine has fluid flow along a first flow path, and the second turbine has fluid flow along a second flow path. The method further includes fixedly coupling an outer wall to the first turbine that directs fluid flow from the first flow path towards the second flow path.

In another aspect, a turbine for use in a power system is provided. The turbine includes a first turbine having a first rotor and fluid flow along a first flow path, a second turbine having a second rotor and fluid flow along a second flow path, a coupling extending between said first and second turbines, the coupling for rotatably coupling the first turbine to the second turbine and an outer wall coupled to the first turbine to direct fluid flow from the first flow path to the second flow path.

In a further aspect, a power system is provided. The power system includes a first turbine including a first rotor and fluid flow along a first flow path, a second turbine comprising a second rotor and fluid flow along a second flow path, a coupling extending between the first and second turbines for rotatably coupling the first and second turbines together and an outer wall fixedly attached to the first turbine such that the outer wall directs fluid flow from the first flow path to the second flow path.

DETAILED DESCRIPTION OF THE INVENTION

Figure 1:
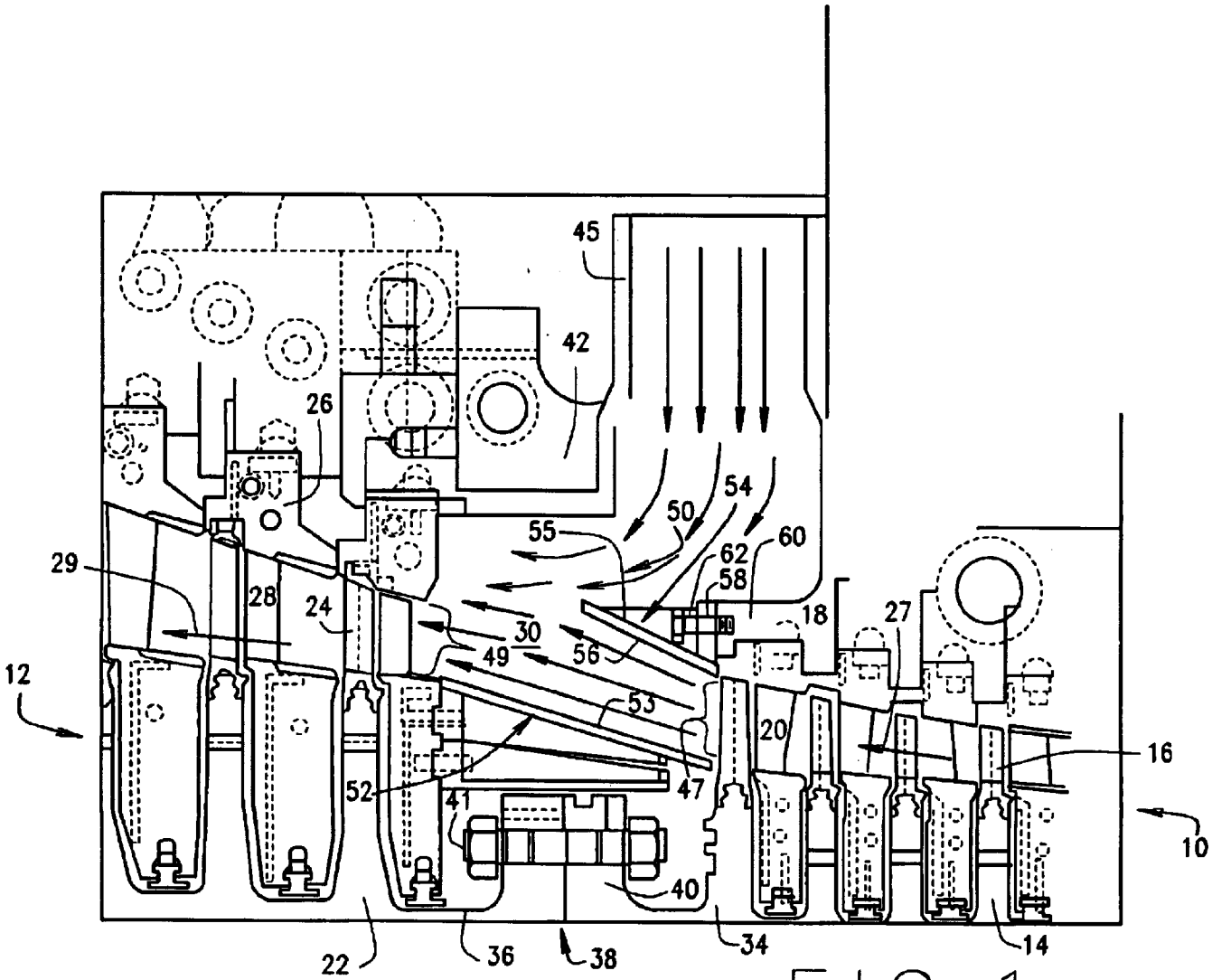
FIG. 1 is a cross-sectional view of first and second turbines coupled to one another illustrating the coupling and flow path therebetween.

Referring to the drawing figures, particularly to FIG. 1, there is illustrated first and second turbines, namely a first or upstream turbine, generally designated 10, and a downstream turbine, generally designated 12, axially coupled together along their flow paths such that their rotor shafts are coupled to one another. First turbine 10 includes a plurality of axially spaced rotor wheels 14 mounting buckets 16 which, together with diaphragms 18 mounting partitions 20, form multiple stages of first turbine 10. Likewise, second turbine 12 includes a plurality of axially spaced rotor wheels 22 mounting buckets 24 which, in conjunction with diaphragms 26 carrying partitions 28, form multiple stages of the second turbine 12.

A fluid, such as steam, passes generally axially past the various stages of the upstream turbine 10 along a first flow path portion indicated by an arrow 27, through an intermediate cavity 30 and through a second flow path portion indicated by an arrow 29 comprised of the various stages of the downstream turbine 12. Thus, flow path portions 27 and 29 and cavity 30 form a flow path through the joined turbines. Additionally, the discrete rotor shafts 34 and 36 of the first and second turbines 10 and 12, respectively, are joined one to the other by a coupling, generally indicated 38. The coupling includes flanges 40 on the ends of the respective rotor shafts with bolts 41 interconnecting the flanges and, hence, the shafts to one another. A radial fluid (steam) admission port 45 is provided through a common outer shell 42 for admitting additional fluid (steam) into intermediate cavity 30 to join the fluid in the flow path. The rotating shafts 34 and 36 and the coupling 38 are exposed to the flow path within cavity 30, with resulting windage loss through turbulent mixing and losses due to flow separation by impact against protuberant surfaces on coupling 38 and other parts.

Common outer shell 42 mounts radial fluid (steam) admission port 45 for admitting fluid (steam) into intermediate cavity 30 for joining with the fluid (steam) exiting an exit annulus 47 of upstream turbine 10 and flowing to entrance annulus 49 of downstream turbine 12.

A diffuser, generally designated 50, forming part of the cavity 30 intermediate first and second turbines 10 and 12, respectively. The diffuser 50 recovers kinetic energy from the fluid (steam), leaving upstream turbine 10 prior to entry into downstream turbine 12. To form diffuser 50, as well as to minimize or eliminate both windage loss and spinning loss, there is provided an inner cover 52 in the form of a surface of revolution, preferably a frustoconical section having an axis coincident with the axis of rotation of combined shafts 34 and 36. Inner cover 52 having an outer surface 53 defines an inner margin of the flow path exiting exit annulus 47 of upstream turbine 10 to entrance annulus 49 of downstream turbine 12. That is, inner cover 52 extends from adjacent the root radius of the buckets forming the final stage of upstream turbine 10 to the inner band of the first stage of downstream turbine. Cover 52 is supported by the first stage diaphragm of the downstream turbine 12. The flow path through intermediate cavity 30 is thus substantially sealed from coupling 38 between the shafts.

Also defining diffuser 50 is an outer wall 54 which forms a generally axially downstream extension of the upstream turbine 10. Outer wall 54 in the form of a surface of revolution, preferably a frustoconical section having an axis coincident with the axis of rotation of combined shafts 34 and 36. The outer wall has an outer wall surface 55 and an inner wall surface 56. Inner wall surface 56 of outer wall 54 in part defines the outer margin of the flow exiting upstream turbine 10. Outer surface 53 of inner cover 52 and inner wall surface 56 thus define an annulus about the flow path whose area increases in a downstream direction toward downstream turbine 12, i.e., form a diffuser. The surfaces of revolution which define the diffuser, i.e., cover 52 and wall 56, may have any annular configuration provided the flow area increases in a downstream direction and the flow path between the exit annulus of the upstream turbine effects a smooth flow transition therebetween.

Figure 2:
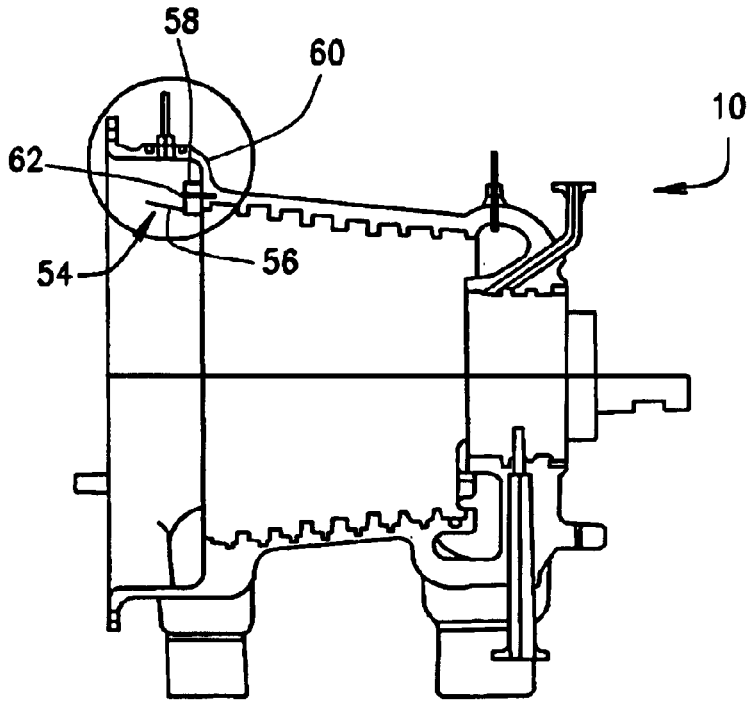
FIG. 2 is a side cross-sectional view of an outer wall coupled to a turbine shown in FIG. 1
Figure 3:
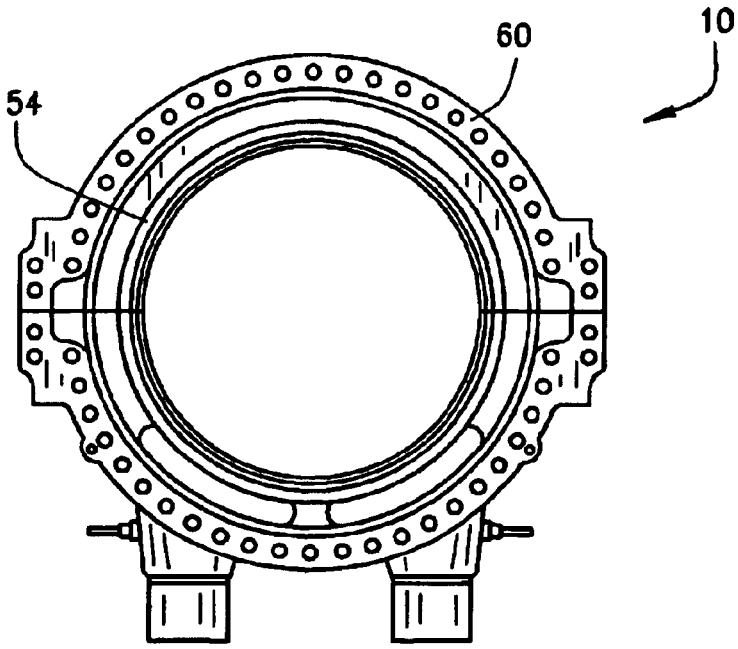
FIG. 3 is a front view of an outer wall coupled to a turbine shown in FIG. 1.
Figure 4:
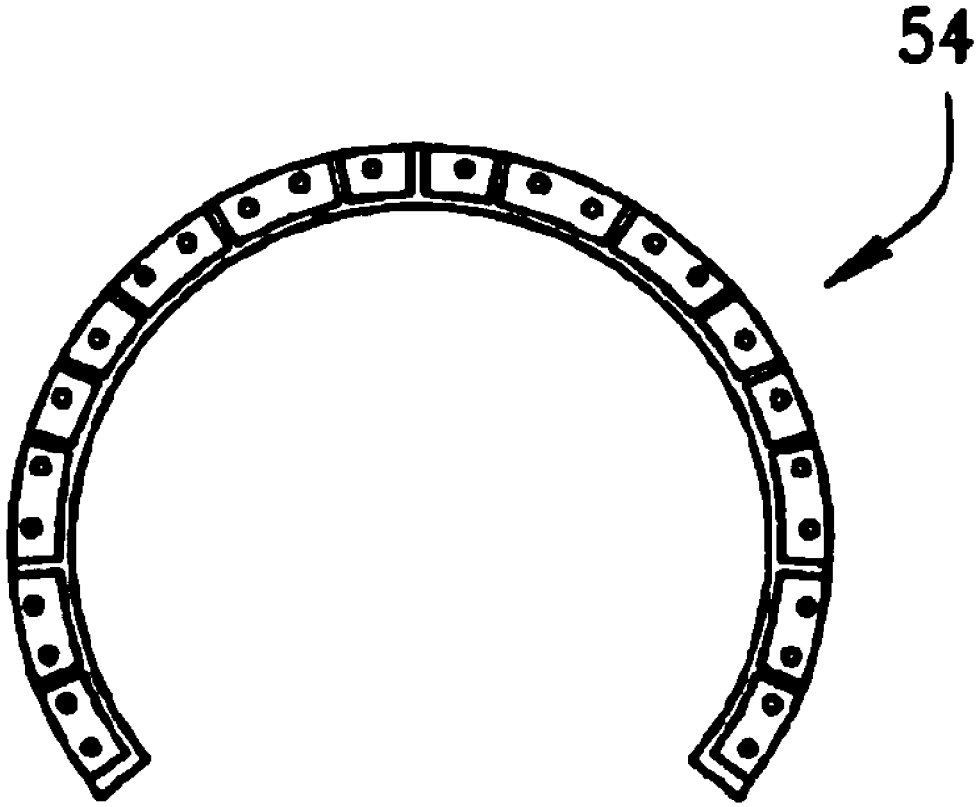
FIG. 4 is a front view of one embodiment of the outer wall coupled to the first turbine shown in FIG. 1.

Outer wall 54 has a flange 58 mounted on its smaller diameter. In one embodiment, flange 58 is mounted along the length of outer wall 54. The flange is welded to the smaller diameter of the frustum and holes are drilled parallel to the axis of rotation through the flange. Although the device is described as being made of steel, it may be made of any material capable of withstanding the environment and mechanical constraints of the application. The outer is fixedly secured to a turbine casing 60 as shown in FIGS. 2 and 3. To apply the outer wall to the turbine casing, holes are drilled in turbine casing 60 and tapped to receive fasteners 62, such as a bolt, through the flange. In one embodiment, the device may be cut into sections to ease installation and may be omitted over sectors of the casing cavity where it would otherwise adversely disturb fluid flow as shown in FIG. 4.

Inlet port 45 provides for radial admission of fluid (steam) into intermediate cavity 30. Inlet port 45 forms part of outer shell 42 common to both the upstream and downstream turbines. Inlet port 45 is configured to turn the generally radially inwardly directed flow as it encounters outer wall surface 55 of outer wall 54 and turns the flow axially and circumferentially before the flow enters coupling cavity 30. Thus, where the inlet flow path meets the axial flow path from the upstream turbine, the velocity of the flow is sufficiently reduced such that mixing losses are reduced.

Diffuser 50 substantially minimizes or eliminates the spinning and windage losses. Moreover, the flow path between the exit annulus of the upstream turbine and the entry annulus of the downstream turbine effects a smooth flow transition therebetween, notwithstanding differences in heights and/or diameters of the exit and entrance annuli 47 and 49, respectively.

The above-described outer wall is cost-effective and time saving. The outer wall includes a flange that facilitates securing the outer wall to a turbine, thus allowing retrofitting previously commissioned turbines. Because the turbine can be drilled and tapped to receive a fastener passing through the flange, installed turbines can be retrofitted with the outer wall. As a result, the outer wall significantly improves the performance of the turbine in a cost-effective and a time-saving manner.

Exemplary embodiments of outer wall are described above in detail. The systems are not limited to the specific embodiments described herein, but rather, components of each outer wall may be utilized independently and separately from other components described herein. Each outer wall component can also be used in combination with other outer wall and turbine components.

While the invention has been described in terms of various specific embodiments, those skilled in the art will recognize that the invention can be practiced with modification within the spirit and scope of the claims.

What is claimed is:

1. A method for assembling a power system, said method comprising:

coupling a first turbine and second turbine together with a coupling that extends between a first rotor of a first turbine and a second rotor of the second turbine, and such that the first turbine has fluid flow along a first flow path, and the second turbine has fluid flow along a second flow path; and fixedly coupling an outer wall to the first turbine that directs fluid flow from the first flow path towards the second flow path.

2. A method in accordance with claim 1 further comprising coupling an inner cover to extend from the first turbine substantially to the second turbine, wherein the inner cover overlies the coupling between the first and second rotors and directs fluid flow from the first flow path towards the second flow path.

3. A method in accordance with claim 2 wherein fixedly coupling an outer wall to the first turbine further comprises securing a flange on the outer wall of the first turbine.

4. A method in accordance with claim 1 further comprising coupling an inner cover to the first turbine such that a substantially annular diffuser is defined by the inner cover and the outer wall, wherein the diffuser extends between the first and second turbines.

5. A turbine for use in a power system, said turbine comprising:

a first turbine having a first rotor and fluid flow along a first flow path;

a second turbine having a second rotor and fluid flow along a second flow path;

a coupling extending between said first and second turbines, said coupling for rotatably coupling said first turbine to said second turbine; and an outer wall coupled to said first turbine to direct fluid flow from the first flow path to the second flow path.

6. A power system in accordance with claim 5 wherein said outer wall is substantially annular.

7. A power system in accordance with claim 6 wherein said outer wall is frustoconical.

8. A power system in accordance with claim 5 wherein said outer wall comprises a flange for fixedly attaching said outer wall to said first turbine.

9. A power system in accordance with claim 5 further comprising an inner cover extending substantially from said first turbine to said second turbine, said inner cover overlying said coupling and configured to channel fluid flow from the first flow path to the second flow path.

10. A power system in accordance with claim 9 wherein said inner cover and outer wall define a diffuser between said first and second turbines.

11. A power system comprising:

a first turbine comprising a first rotor and fluid flow along a first flow path;

a second turbine comprising a second rotor and fluid flow along a second flow path, a coupling extending between said first and second turbines for rotatably coupling said first and second turbines together; and an outer wall fixedly attached to said first turbine such that said outer wall directs fluid flow from the first flow path to the second flow path.

12. A power system in accordance with claim 11 wherein said outer wall is substantially annular.

13. A power system in accordance with claim 12 wherein said outer wall is frusto-conical.

14. A power system in accordance with claim 11 wherein said outer wall comprises a flange for coupling said outer wall to said first turbine.

15. A power system in accordance with claim 11 further comprising an inner cover extending substantially from said first turbine to said second turbine, said inner cover overlying said coupling such that said inner cover directs fluid flow from the first flow path to the second flow path.

16. A power system in accordance with claim 15 wherein said inner cover and outer wall define a diffuser between said first and second turbine.

* * * * *